US009175447B2

(12) United States Patent
Steffen

(10) Patent No.: US 9,175,447 B2
(45) Date of Patent: Nov. 3, 2015

(54) SOIL COMPACTOR HAVING DIRECT DRIVE

(71) Applicant: Wacker Neuson Produktion GmbH & Co. KG, Munich (DE)

(72) Inventor: Michael Steffen, Munich (DE)

(73) Assignee: Wacker Nenson Produktion GmbH & Co. KG, Munich (DE)

( * ) Notice: Subject to any disclaimer, the term of this patent is extended or adjusted under 35 U.S.C. 154(b) by 0 days.

(21) Appl. No.: 14/560,084

(22) Filed: Dec. 4, 2014

(65) Prior Publication Data

US 2015/0167259 A1 Jun. 18, 2015

(30) Foreign Application Priority Data

Dec. 12, 2013 (DE) ..... 10 2013 020 857

(51) Int. Cl.

| | |
|---|---|
| ***E01C 19/30*** | (2006.01) |
| ***E01C 19/35*** | (2006.01) |
| ***E01C 19/38*** | (2006.01) |
| ***E02D 3/046*** | (2006.01) |

(52) U.S. Cl.
CPC ..... *E01C 19/35* (2013.01); *E01C 19/38* (2013.01); *E02D 3/046* (2013.01)

(58) Field of Classification Search
CPC ..... E02D 3/046; E02D 3/068; E01C 19/35; E01C 19/38
USPC ..... 404/133.05, 133.1, 72, 75
See application file for complete search history.

(56) References Cited

U.S. PATENT DOCUMENTS

| | | | | |
|---|---|---|---|---|
| 4,488,076 | A * | 12/1984 | MaCleod | 310/171 |
| 7,682,102 | B1 * | 3/2010 | Burke et al. | 404/133.1 |
| 2006/0165488 | A1 | 7/2006 | Morris et al. | |
| 2010/0296869 | A1 * | 11/2010 | Catanzarite et al. | 404/133.1 |
| 2011/0163516 | A1 * | 7/2011 | Whinnery | 280/296 |
| 2013/0004237 | A1 * | 1/2013 | Krings et al. | 404/75 |

FOREIGN PATENT DOCUMENTS

| | | | | |
|---|---|---|---|---|
| DE | 629 006 | C | 4/1936 | |
| DE | 10 2010 015 950 | A1 | 9/2011 | |
| DE | 10 2010 055 632 | A1 | 6/2012 | |
| GB | 1407131 | * | 3/1973 | B65G 27/32 |

OTHER PUBLICATIONS

German Search Report Dated Sep. 5, 2014 for German Patent Application Serial No. 10 2013 020 857.2.

* cited by examiner

*Primary Examiner* — Raymond W Addie
(74) *Attorney, Agent, or Firm* — Boyle Fredrickson, S.C.

(57) ABSTRACT

A soil compacting device has an upper mass and a lower mass that is coupled to the upper mass by a spring device and that has a soil contact element. In addition, a drive is provided for producing a working movement of the soil contact element. The drive has an electric motor, a drive frequency of a drive movement produced by the electric motor being equal to a frequency of the working movement of the soil contact element.

14 Claims, 1 Drawing Sheet

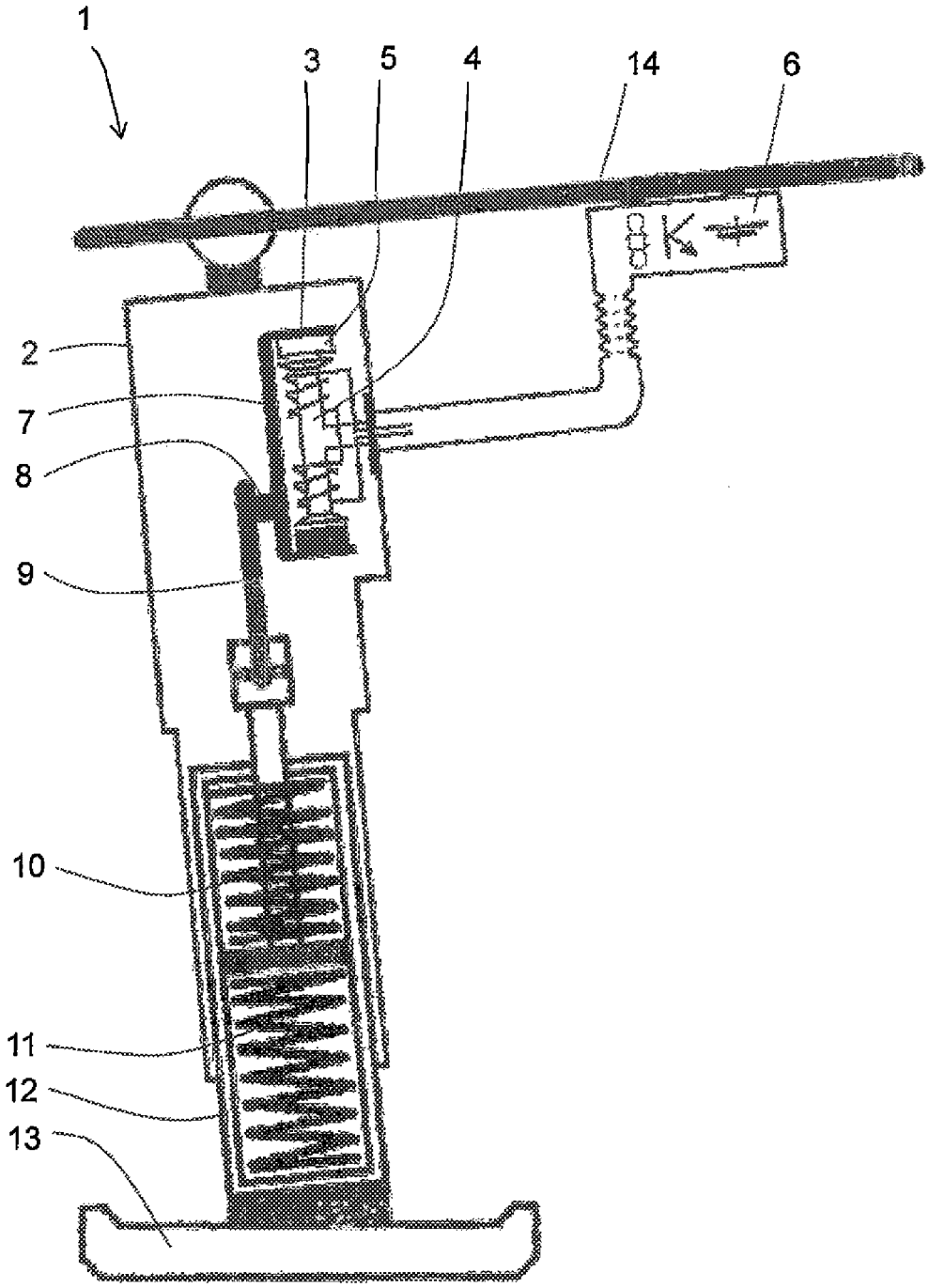
1
3
5
4
14
6
2
7
8
9
10
11
12
13

SOIL COMPACTOR HAVING DIRECT DRIVE

BACKGROUND OF THE INVENTION

1. Field of the Invention

The present invention relates to a soil compacting device and to a method for operating a soil compacting device. The present invention can be used for working machines for soil compaction, such as tampers or vibrating plates.

2. Description of the Related Art

Soil compacting machines are typically driven by internal combustion engines and/or electric motors. While internal combustion engines enable largely independent operation of the soil compacting device due to the storage of the fuel in a tank on the machine, through the use of electric motors stress on the environment and on an operator operating the soil compacting machine can be avoided. The supply of power to the electric motor generally takes place via an external connection to the public power supply network or, for example in the case of smaller soil compacting machines, via an electric accumulator.

With the use of electric motors, the rotational frequency of the electric motors required to produce the motor power is significantly higher than the operating frequency of the compactor, i.e. the tamping or vibration frequency. As a consequence, reduction gear mechanisms are provided between the drive motor and the tamper or vibration system, which reduce the frequency of rotation of the drive movement produced by the electric motor and increase the drive torque.

Such reduction gear mechanisms contain complex assemblies that require adequate constructive space, have a high weight, and result in high production costs. During operation, they are exposed to strong loads, have a high degree of wear, and thus result in limited reliability of the overall system.

During the driving of the soil compactors, fast-rotating electric motors consequently act on the soil contact element via step-down gear mechanisms and spring packets. Thus, as a result of the design it is not possible to infer the position of the tamper foot and its loading condition from the angle of rotation of the drive motor. Rather, the tamper frequency, an impact speed, and the temporal course of the impact process are a function of the system variables of the soil compacting device and of the condition (rigidity) of the soil being compacted.

In their conception and design, tampers are adapted to the conditions of uncompacted standard soils in such a way that the best possible compaction effect of the machine is achieved precisely when the properties of the soil agree with the soils taken into account in the dimensioning of the tamper system. When compacting soils having different properties, the tamper effect can therefore be less.

SUMMARY OF THE INVENTION

The object of the present invention is to indicate a soil compactor device that enables reliable operation with a simultaneously high degree of efficiency of the overall system and low production costs. At the same time, the present invention is based on the object of indicating a method for operating such a soil compacting device.

These objects are achieved by a soil compacting device that has an upper mass and a lower mass that has a soil contact element and is coupled to the upper mass by a spring device. In addition, a drive is provided for producing a working movement of the soil contact element. The drive has an electric motor, and a drive frequency of a drive movement produced by the electric motor is equal to a frequency of the working movement of the soil contact element.

The equality of the drive frequency of the electric motor and the frequency of the working movement is achieved in the soil compacting device through a synchronization of the electric motor with the frequency of the working movement. Consequently, the working movement is transmitted to the soil contact element without changing the frequency. This means in particular that the frequency of rotation of the electric motor, for example the frequency of rotation of a drive element or of a drive shaft of the electric motor, corresponds to a frequency of the working movement of the soil contact element, e.g. a soil contact plate. Correspondingly, a rotation of the drive element of the electric motor corresponds precisely to a working or tamping cycle, or to the tamping frequency, of the soil contact plate.

The synchronization of the electric motor with the working frequency makes it possible for the electric motor to directly produce the working movement. In particular, the working movement of the drive element can be transmitted to the soil contact element directly and without converting its frequency. Accordingly, it is not necessary to provide for example gear mechanism devices or other transmission elements for the conversion, for example reduction, of the drive frequency. In the following, this is referred to as a direct drive.

The synchronization of the electric motor with the working frequency thus enables a direct connection of the electric motor with the tamper system on the lower mass, or with a connecting rod of the tamper system. This results in a phase-defined connection between the electric motor and the tamper system. In particular, due to the lack of a clutch the position of the tamper system (tamper connecting rod) and the angle of rotation of the drive shaft of the electric motor or of the rotor shaft relative to one another is always precisely defined, so that knowledge of the one always permits inference of the other, and vice versa. Through the direct drive of the soil contact element by the electric motor, a particularly simple construction of the soil compacting device is possible, because transmission devices or other transmission elements for converting the frequency can be done without.

The direct drive makes it possible to indicate a soil compacting device that is significantly smaller and lighter than for example a conventional tamper, or a conventional vibrating plate having a gear transmission device. In particular, a lower weight of the upper mass can be achieved. resulting in a lower center of gravity and thus better steering properties. Low production costs are achieved by the low mechanical complexity of the overall system.

In working operation, the direct drive, and in particular the direct connection of the electric motor to the tamper system, enables an effective, precise, and low-noise transmission of the drive movement to the soil contact element. In this way, a low-noise and low-maintenance operation is possible with a high degree of efficiency of the overall system, in which little wear occurs.

In a specific embodiment, the electric motor has a direct current motor, a three-phase motor, or an alternating current motor having a high number of pole pairs. For example, the direct, three-phase, or alternating current motor can have at least two, three, four, five, eight, or ten pole pairs, each made up of a north and south pole. For example, the direct, three-phase, or alternating current motor can have at least eight poles, or can have a pole pair number of at least eight pole pairs.

In particular, through a large number of pole pairs an electric motor can be achieved having a low rotational speed, for example matching the working frequency of the soil compacting device. At the same time, the rotational torque of the electric motor is increased, in a manner proportional to the number of pole pairs. Accordingly, at the same time a large drive torque is achieved that is suitable for driving the soil contact element in the working movement. Consequently, a three-phase or alternating current motor having a high number of pole pairs is suitable to enable a direct drive of the soil compacting device.

In a further specific embodiment, the electric motor has a torque motor.

A torque motor is a magnetic motor having strong torque, or a switched reluctance motor, or a slow-running electric motor such as an electric asynchronous motor having a high number of pole pairs. Corresponding to the above considerations, torque motors have high torque at low rotational speeds. This can be used in the manner described above for the direct drive of the soil compacting device.

Torque motors can be realized as brushless direct current motors, and can be fashioned as external rotors having an interior stator and exterior rotor, or as internal rotors having an interior rotor and exterior stator. Their large torque can cause large accelerations, and results in a high dynamic characteristic of the operating behavior of the soil compacting device. The high starting torque present already at the start makes it possible to start the soil compacting device using the torque motor alone. The high degree of drive rigidity of torque motors permits essentially no play, and for this reason torque motors have good regulation properties that make it possible to precisely realize the working demands made on the soil compacting device.

An electronic frequency transformer that provides a feed current having a suitable frequency for operating the torque motor can be positioned upstream from the torque motor.

Despite the comparatively high costs of procurement of torque motors, the overall system of the soil compacting device can be realized at low cost, because additional costs, for example for gear mechanisms and further transmission elements, can be saved.

In a further specific embodiment, the electric motor has an asynchronous motor having a high number of pole pairs and/or a squirrel cage drive motor having a high number of pole pairs. For example, the asynchronous motor, or squirrel cage drive motor, can have 2, 3, 4, 5, 8, 10, or more pole pairs. In particular, the asynchronous motor, or the squirrel cage drive motor, can have at least 8 poles, or can have a number of pole pairs of at least 8 pole pairs.

The use of asynchronous motors or squirrel cage drive motors permits a low-cost realization of the soil compacting device. The provision of a large number of pole pairs makes it possible to indicate a high-torque drive having a low rotational speed that enables direct drive of the soil contact element of the soil compacting device. The asynchronous motor or squirrel cage drive motor can for example be realized in such a way that given operation at network frequency, for example of the public power grid, a direct drive of the soil contact element is possible with a suitable tamping frequency. Alternatively, a frequency transformer can also be provided in order to transform the network frequency in order to enable operation of the soil compacting device with a suitable working movement of the soil contact element, for example feeding the electric motor from the public power grid or from an accumulator with direct current-alternating current conversion.

In a further specific embodiment, the electric motor can have a sensor-commutated brushless magnetic motor having an electronic control device, or can be fashioned as such.

A sensor-commutated brushless magnetic motor having electronic controlling has sensors for determining the position of a rotor of the electric motor relative to the stator field. In this way, the stator coils can be supplied with current as a function of the current rotor position and according to a required movement.

As sensors, for example Hall sensors can be used to acquire the magnetic flux of the rotor, or optical sensors in the area of the stator can be used. For example, the signals of the sensors can be outputted via an incremental encoder, for example set to zero at a specified rotor position.

From the sensor signals, the control device can determine the position of the rotor, and thus, in the case of a directly acting drive, also the position of the soil contact element, i.e. of the tamper foot, relative to the soil compactor and therefore also relative to the soil. On the basis of this position information, the electronic control device can, via suitable power drivers, suitably control or supply with current the windings that produce a torque in the rotor. This controlling can be carried out as a function of a required movement of the tamper and/or as a function of the position of the rotor or of the tamper foot. In the following, this is referred to as sensor-controlled commutation.

Through sensor-controlled commutation, a controlling as needed of the working frequency of the soil compacting device can be achieved, and a working movement of the soil contact element can be directly influenced. The sensor-controlled commutation functions even at very low rotational speeds or at a standstill. Standardly, here, in particular in the case of three or more phases, not all phases are supplied with current at the same time, so that at each point in time at least one phase may be currentless.

In a further specific embodiment, a drive movement of the electric motor can be transmitted to the soil contact plate via a crank drive. In particular, a connecting rod of the crank drive can be coupled eccentrically to a rotor device of the electric motor. The coupling can be achieved for example by a crank pin situated eccentrically on the rotor device of the electric motor.

In particular, the electric motor can have a stationary stator device and a rotor device that is capable of rotation relative to the stator device, the rotor device being capable of rotation relative to the stator device through the action of the fed-in three-phase or alternating current. The connecting rod of the crank drive can be coupled to the rotor device, for example by the crank pin situated eccentrically on the rotor device. This pin can form a robust connection between the rotor device and the connecting rod.

Through the direct connection of the connecting rod to the rotor device, a direct transmission of the drive torque of the electric motor to the connecting rod, and via the connecting rod to the soil contact element, is achieved without requiring gear mechanism devices or other transmission elements. In this way, the drive movement can be transmitted to the soil contact element effectively and without interference. In addition, during operation of the soil compacting device the connecting rod can be suitably guided by the rotor. In this way, disturbing influences from the working operation of the soil compacting device, e.g. reflections of the soil contact element from the soil being processed, can be intercepted and checked.

In a further specific embodiment, the electric motor and the crank drive can be constructively integrated.

For example, the rotor device of the electric motor can have an eccentric element, for example an eccentric disc, to which the connecting rod is fastened for example by the crank pin.

This enables a particularly compact and robust, low-cost, and low-wear construction of the soil compacting device.

In a further variant, an electrical energy storage device and/or a connecting device for connection to a power source can be provided. The electric motor can be supplied with electrical energy from the electrical energy storage device and/or from the power source.

The power source can be provided for example by a public power grid and/or by a generator. The use of a power source situated for example externally to the soil compacting device makes it possible to operate the soil compacting device, after connection to the power source, with low exhaust gas emissions and low noise, and thus in a manner protective of the operator and the environment. The use of an internal, i.e. situated on the soil compactor, electrical energy storage device that can be charged through connection to an external source of electric power in addition enables cordless operation of the soil compacting device, independent of access to a power source.

In a variant of this specific embodiment, a frequency transformer can be provided in order to produce a three-phase or alternating current for the electric motor with a predetermined frequency or a frequency selectable by the operator.

For example, the frequency transformer can be constructively integrated with the electric motor, enabling a simple construction of the soil compacting device having small constructive space. It is also possible to provide the frequency transformer separately from the electric motor, or to provide an external frequency transformer in order to provide a supply current having the frequency required by the electric motor. The frequency of the supply current can for example be controllable with regard to the working demands made on the soil compacting device.

In a further specific embodiment, the drive can have an additional motor, and the additional motor can be capable of being operated alternatively to or in addition to the electric motor. The additional motor can be a further electric motor or an internal combustion engine.

The use of the additional motor makes it possible to drive the soil compacting device according to need. For example, the electric motor and the additional motor can drive the working movement of the soil contact element in alternating fashion or simultaneously, for example through alternating or simultaneous action on the connecting rod. For this purpose, for example an angled shaft can be provided having a plurality of crank pins for driving by a plurality of motors.

The provision of an internal combustion engine in addition to the electric motor makes possible a hybrid drive of the soil compacting device, for example as a function of whether an electrical energy storage device is charged, an external power source is available, and/or whether a tank container of the internal combustion engine has been filled. In this way, the greatest possible degree of independence is achieved from the availability of the energy sources, and thus a high degree of availability of the soil compacting device in various working scenarios is achieved.

In a method for operating a soil compacting device, the soil compacting device has an upper mass, a lower mass coupled to the upper mass by a spring device and having a soil contact element, and a drive for producing a drive movement of the soil contact element. The drive has an electric motor, and a drive frequency of a drive movement produced by the electric motor is equal to a frequency of the working movement of the soil contact element. For example, the soil compacting device can correspond to one of the above-discussed specific embodiments and variants. The method includes a feeding of a three-phase or alternating current to the electric motor and a translation of the drive movement of the electric motor into a working movement of the soil contact element having the same frequency.

The method thus enables the operation of a soil compacting device with a direct drive, in which a frequency of rotation of a drive element of the electric motor corresponds to a frequency of the working movement of the soil contact plate.

In a specific embodiment of the method for operating the soil compacting device, after a force impact of the soil contact plate (e.g. against soil that is to be compacted), a controlling of the electric motor can be provided in order to produce at least one further drive movement of a drive shaft of the electric motor. The further drive movement can be designed to produce at least one further force impact of the soil contact plate (e.g. against the soil being compacted), the further drive movement having a higher drive frequency than a drive frequency of the drive shaft at the moment of the force impact.

The higher drive frequency of the further drive movement can be clearly and significantly greater than the drive frequency at the moment of the force impact. For example, the higher drive frequency can be higher by at least 30% than the drive frequency at the moment of the force impact.

This specific embodiment makes it possible to set a multiple impact of the soil compacting device, as well as restriking. Here, immediately after the force impact exerted on the soil by the tamper foot, further force impacts can be produced. This is achieved through suitable moderation of the drive after the setting of the tamper foot on the soil, in particular through a suitable electromagnetic excitation of the drive motor. Because the drive movement of the drive motor is transferred with the same frequency, or rigidly, to the tamper foot, a precise controlling of the multiple impact, or restriking, is possible. For example, the drive motor can be controlled in such a way that a sequence of rotational impulses, in rapid succession, of the drive shaft/rotor shaft is produced with a very high drive frequency and transmitted to the tamper foot.

In a further specific embodiment of the method for operating the soil compacting device, the further drive movement can have at least one partial movement having a direction of rotation of the drive shaft that is opposite to a direction of rotation of the drive shaft at the moment of the force impact.

This makes it possible, in the named sequence of rotational impulses in rapid succession having a high drive frequency, also to carry out rotational movements of the drive shaft/rotor shaft with an opposite direction of rotation. This enables a very rapid restriking, because the rotational cycle does not have to be terminated before the restriking, but rather can be temporarily reversed, even multiple times. This makes it possible, for example in response to an operator command, to produce a very rapid sequence of short tamping movements.

In this way, the soil to be compacted by the tamper foot/soil contact element is compacted multiple times and with impact pulses succeeding one another rapidly, resulting in additional compacting of the earth. Due in particular to the fact that from the already-accomplished contact of the tamper foot with the soil there occurs no reflection, or only minimal reflection, of the force impulse, a very effective compacting of the soil can be achieved.

These and additional features of the present invention are explained in more detail below on the basis of examples, with reference to the accompanying FIGURE.

BRIEF DESCRIPTION OF THE DRAWING

The FIGURE shows a soil compacting device in which a working movement of a soil contact plate of the soil compacting device is produced by an electric motor that is synchronized with a frequency of the working movement.

DETAILED DESCRIPTION OF THE PREFERRED EMBODIMENT

The FIGURE schematically shows, in a lateral sectional view, a tamper 1 acting as soil compacting device, in which an electric motor 3 is provided in a housing 2. Electric motor 3 has a stator 4 and a rotor 5 that can be rotated relative to the stator 4, and is supplied with energy from an electrical energy storage device 6 situated on tamper 1.

Constructively integrated with rotor 5 is an eccentric disc 7 on which a crank pin 8 is eccentrically situated. Connected to crank pin 8 is a connecting rod 9 for converting the rotational drive movement of rotor 5 into a translational and oscillating up-and-down movement, and for transmitting the up-and-down movement to a tamper foot 12 coupled to connecting rod 9 via spring packets 10 and 11, on which foot there is situated a soil contact plate 13 as soil contact element. The resultant operational coupling of the tamper foot 12 to the rotor 5 assures that the connecting rod 9 and tamper foot move at the same frequency as the rotor 5 at all times.

In working operation of tamper 1, electrical energy previously stored in electrical energy storage device 6 situated on a guide bracket 14 of tamper 1 is used to produce an alternating or three-phase current, for example with the aid of a frequency transformer. The alternating or three-phase current is supplied as supply current to stator 4 of electric motor 3. In this way, alternating magnetic fields are produced in the region of rotor 5, and rotor 5 is set in a known manner into rotational motion, which is the drive motion of electric motor 3.

The frequency of rotation of rotor 5, or drive frequency of the drive motion, is here directly determined by a frequency of the alternating or three-phase current supplied to stator 4. The drive or rotational movement of rotor 5, which is integrated constructively with the crank drive formed by eccentric disc 7, crank pin 8, and connecting rod 9, is converted in synchronized fashion, i.e. with the same frequency, into a working movement of tamper foot 12 and of soil contact plate 13 situated thereon. In this way, soil contact plate 13 is directly driven by electric motor 3 with synchronized frequency.

The direct drive makes it possible to realize tamper 1 without additional gear mechanism devices, or without further frequency-converting transmitting elements. In this way, lower complexity of the overall system is achieved, resulting in lower production costs, lower maintenance outlay, a high degree of overall efficiency, and a high degree of reliability of tamper 1. The design is low-noise and low-wear and has, in comparison to conventionally driven tampers, a low center of gravity and therefore improved steering behavior.

Electric motor 3 can for example have a three-phase or alternating current motor having a high number of pole pairs, a torque motor, an asynchronous motor having a high number of pole pairs, and/or a squirrel cage drive motor having a high number of pole pairs.

What is claimed is:

1. A soil compacting device, comprising:

an upper mass and a lower mass that is coupled to the upper mass by a spring device and that has a soil contact element, and a drive for producing a working movement of the soil contact element, the drive having an electric motor having an output that is driven to operate at a drive frequency, and the electric motor output being operationally coupled to the soil contact element such the drive frequency of the electric motor output is always equal to a frequency of the working movement of the soil contact element.

2. The soil compacting device of claim 1, the electric motor being one of a direct-cunent motor, a three-phase motor, and an alternating current motor having a high number of pole pairs.

3. The soil compacting device of claim 1, the electric motor being a torque motor.

4. The soil compacting device of claim 1, the electric motor being at least one of an asynchronous motor that has a high number of pole pairs, and a squirrel cage drive motor having a high number of pole pairs.

5. The soil compacting device of claim 1, the electric, motor being a sensor-commutated brushless magnetic motor having an electronic control device.

6. The soil compacting device of claim 1, wherein the motor output comprises a rotor device that is excited to rotate by a stator of the electric motor.

7. The soil compacting device of claim 6, the drive movement of the electric motor being capable of being transmitted to the soil contact element via a crank drive, and a connecting rod of the crank drive being coupled eccentrically to the rotor device of the electric motor such that the crank drive and rotor device always move together.

8. The soil compacting device of claim 7, the electric motor and the crank drive being constructively integrated with one another.

9. The soil compacting device of claim 1, further comprising at least one of an electrical energy storage device and a connecting device for connection to a power source, and wherein the electric motor is capable of being supplied with electrical energy from the at least one of the electrical energy storage device and the power source.

10. The soil compacting device of claim 1, further comprising a frequency transformer for producing a three-phase or alternating current for the electric motor with a specified frequency.

11. The soil compacting device of claim 1, the drive having an additional motor, the additional motor being capable of being operated alternatively to or in addition to the electric motor, and the additional motor being one of an additional electric motor and an internal combustion engine.

12. A method for operating a soil compacting device, the soil compacting device having an upper mass, a lower mass that is coupled to the upper mass by a spring device and that has a soil contact element, and a drive for producing a working movement of the soil contact element, the drive having an electric motor having an output that is operationally coupled to the soil contact element, the method comprising:

controlling a drive frequency the electric motor output to be equal to a frequency of the working movement of the soil contact element at all times, wherein the motor is fed with one of a three-phase current and an alternating current.

13. The method for operating a soil compacting device in claim 12, wherein the motor output is a drive shaft and the soil contact element is a soil contact plate, and further comprising, after the contact plate experiences a force impact controlling the electric motor in order to produce at least one further drive movement of the drive shaft of the electric motor, the further drive movement being designed to produce at least one additional force impact of the soil contact plate, and wherein the further drive movement has higher drive frequency than the drive frequency of the drive shaft at the moment of the force impact.

14. The method for operating a soil compacting device in claim 12, wherein the motor output comprises a rotor device that is excited to rotate by a stator of the electric motor.

* * * * *